US012595102B2

(12) United States Patent
Grey et al.

(10) Patent No.: US 12,595,102 B2
(45) Date of Patent: Apr. 7, 2026

(54) ARTICLE CARRIER AND BLANK THEREFOR

(71) Applicant: WestRock Packaging Systems, LLC, Atlanta, GA (US)

(72) Inventors: Casey P. Grey, Richmond, VA (US); Noah Dean, Newport News, VA (US); Joel C. Panek, Moseley, VA (US); John D. Benson, North Charleston, SC (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/726,725

(22) PCT Filed: Jan. 9, 2023

(86) PCT No.: PCT/US2023/060294

§ 371 (c)(1),
(2) Date: Jul. 3, 2024

(87) PCT Pub. No.: WO2023/133545

PCT Pub. Date: Jul. 13, 2023

(65) Prior Publication Data

US 2025/0091781 A1 Mar. 20, 2025

Related U.S. Application Data

(60) Provisional application No. 63/297,779, filed on Jan. 9, 2022.

(51) Int. Cl.
*B65D 71/50* (2006.01)

(52) U.S. Cl.
CPC ..... *B65D 71/50* (2013.01); *B65D 2571/0029* (2013.01); *B65D 2571/0066* (2013.01)

(58) Field of Classification Search
CPC ..... B65D 71/50; B65D 71/504; B65D 2571/0029; B65D 2571/0066
(Continued)

(56) References Cited

U.S. PATENT DOCUMENTS 3,374,028 A * 3/1968 Wanderer ..... B65D 71/504 294/87.2
3,874,502 A * 4/1975 Weaver ..... B65D 71/504 206/161
(Continued)

FOREIGN PATENT DOCUMENTS

WO 2020210562 A1 10/2020
WO 2021006963 A1 1/2021
(Continued)

OTHER PUBLICATIONS

PCT/US23/60294 International Search Report dated May 9, 2023, 3 pages.

*Primary Examiner* — Bryon P Gehman
(74) *Attorney, Agent, or Firm* — Brian J. Goldberg; Rohini K. Garg; Tsugihiko Suzuki

(57) ABSTRACT

Aspects of the disclosure relate to an article carrier for packaging one or more articles and a blank for forming the carrier. The carrier comprises a main panel having one or more article retention structures for receiving and securing the main panel to a respective article. The article retention structures each comprise a perimeter. The perimeter is interrupted by at least one major cutaway in the form of a notch or recess, and at least one minor cutaway in the form of a notch or recess, wherein the at least one major cutaway comprises a first angular dimension and the at least one minor cutaway comprises a second angular dimension, the first angular dimension being greater in magnitude than the second angular dimension.

15 Claims, 10 Drawing Sheets

(58) Field of Classification Search
USPC ..... 206/150, 429; 294/87.2
See application file for complete search history.

(56) References Cited

U.S. PATENT DOCUMENTS

| | | | | |
|---|---|---|---|---|
| 4,911,289 | A * | 3/1990 | Bird | B65D 71/504<br>206/427 |
| 2023/0077309 | A1 | 3/2023 | Zacherle et al. | |

FOREIGN PATENT DOCUMENTS

| | | | |
|---|---|---|---|
| WO | 2021168417 | A1 | 8/2021 |
| WO | 2021188751 | A1 | 9/2021 |

* cited by examiner

ARTICLE CARRIER AND BLANK THEREFOR

CROSS-REFERENCE TO RELATED APPLICATIONS

The present application is a 35 U.S.C. §§ 371 national stage application of PCT/US2023/60294 filed on 9 Jan. 2023, which claims the benefit of priority to U.S. Provisional Patent Application Ser. No. 63/297,779 filed on 9 Jan. 2022, the contents of each of which are incorporated herein by reference in their entirety.

TECHNICAL FIELD

The present disclosure relates to article carriers and to blanks for forming the same. More specifically, but not exclusively, the disclosure relates to a carrier of the top-gripping type having one or more apertures for receiving and retaining an article therein.

BACKGROUND

In the field of packaging, it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel and are arranged about the aperture. The tabs are displaced out of the plane of said panel when an article is received in the aperture, wherein said tabs engage the article generally about a flange or lip of the article.

The present disclosure seeks to provide an improvement in the field of cartons, typically formed from paperboard or the like.

SUMMARY

A first aspect to the disclosure provides an article carrier for packaging at least one article. The carrier includes a main panel having at least one article retention structure for engaging an article. The at least one article retention structure comprises an aperture having a perimeter. The perimeter of the aperture includes a first load bearing edge having a first radius of curvature and a second load bearing edge having a second radius of curvature. The second radius of curvature is greater than the first radius of curvature. The second load bearing edge is interrupted by at least one cutaway such that the second load bearing edge is divided by the at least one cutaway into two or more arcuate segments each having the second radius of curvature.

Optionally, the two or more arcuate segments have different centers of curvature spaced apart from each other.

Optionally, the at least one cut away comprises at least two cutaways.

Optionally, each of the at least two cutaways is disposed between the two or more arcuate segments.

Optionally, the second load bearing edge is disposed in closer proximity to a side edge of the main panel than the first load bearing edge.

Optionally, the second load bearing edge is disposed in closer proximity to an end edge of the main panel than the first load bearing edge.

Optionally, the second load bearing edge is disposed in closer proximity to a corner of the main panel than the first load bearing edge.

A second aspect of the disclosure provides an article engaging carrier for packaging at least one article. The carrier comprises a main panel having at least one article retention structure for engaging an article. The article retention structure comprises an aperture having a perimeter. The perimeter is interrupted by at least one major cutaway and by at least one minor cutaway. The at least one major cutaway comprises a first width or angular dimension and the at least one minor cutaway comprises a second width or angular dimension. The first width is greater in magnitude than the second width.

Optionally, the perimeter of the aperture includes a load bearing edge for engaging an upper rim of an article to be received in the at least one article retention structure. The load bearing edge extends between the at least one major cutaway and the at least one minor cutaway.

Optionally, the perimeter is defined by a first load bearing edge having a first radius of curvature and at least one second load bearing edge having a second radius of curvature. The second radius of curvature is larger than the first radius of curvature.

Optionally, the first load bearing edge is interrupted by the at least one minor cutaway.

Optionally, the at least one second load bearing edge is interrupted by the at least one major cutaway.

Optionally, the first angular dimension is between three and six times greater in magnitude than the second angular dimension.

Optionally, the at least one major cutaway and the at least one minor cutaway each comprise a maximum radial dimension. The maximum radial dimension of the at least one major cutaway and the maximum radial dimension of the at least one minor cutaway may be equal to each other.

Optionally, the at least one major cutaway comprises two or more major cutaways. The at least one second load bearing edge extends between of the two or more major cutaways.

Optionally, the at least one second load bearing edge is disposed in closer proximity to a side edge of the main panel than the first load bearing edge.

Optionally, the at least one second load bearing edge is disposed in closer proximity to an end edge of the main panel than the first load bearing edge.

Optionally, the at least one second load bearing edge is disposed in closer proximity to a corner of the main panel than the first load bearing edge.

Optionally, the at least one second load bearing edge and the first load bearing edge define an aperture width of the aperture. The aperture width is smaller than the diameter of an upper rim of an article to be received in the article retention structure.

Optionally, the maximum radial dimension of the at least one major cutaway and the maximum radial dimension of the at least one minor cutaway each is equal to the difference between the first radius of curvature and the radius of curvature of an upper rim of an article to be received in the article retention structure.

Optionally, radially outermost ends of the at least one major cutaway and the at least one minor cutaway are disposed generally on a notional circle defined by the outer perimeter of an upper rim of an article receivable in the article retention structure.

Optionally, the at least one major cutaway and the at least one minor cutaway are in tangential contact with a notional circle defining the outer perimeter of an upper rim of an article to be received in the article retention structure. The first and second load bearing edges are disposed within the notional circle.

Optionally, the article retention structure comprises at least three cutaways including the at least one major cutaway and the at least one minor cutaway.

Optionally, the at least one major cutaway is diagonally opposed to the at least one minor cutaway.

Optionally, the at least one major cutaway and the at least one minor cutaway define an aperture width substantially equal to the diameter of an upper rim of an article to be received in the article retention structure.

Optionally, the at least one major cut away comprises at least two major cutaways two of which are disposed orthogonally to each other.

Optionally, the at least one minor cutaway comprises at least two minor cutaways two of which are disposed orthogonally to each other.

Optionally, the perimeter is defined by at least two second load bearing edges each having a second radius of curvature, the second radius of curvature being larger than the first radius of curvature, and wherein a major cutaway is disposed at the intersection of two notional circles defining the at least two second portions.

Optionally, the intersection is disposed withing the aperture.

Optionally, the main panel comprises two or more article retention structures and wherein the minor cutaway of a first article retention structure is disposed in back-to-back relationship with the minor cutaway of a second article retention structure.

Optionally, the at least one major cutaway is disposed between a pair of arcuate segments.

A third aspect of the disclosure provides a blank for forming an article carrier for packaging at least one article. The blank comprises a main panel having at least one article retention structure for engaging an article. The at least one article retention structure comprises an aperture having a perimeter. The perimeter of the aperture includes a first load bearing edge having a first radius of curvature and a second load bearing edge having a second radius of curvature. The second radius of curvature is greater than the first radius of curvature. The second load bearing edge is interrupted by at least one cutaway such that the second load bearing edge is divided by the at least one cutaway into two or more arcuate segments each having the second radius of curvature.

Optionally, the two or more arcuate segments have different centers of curvature spaced apart from each other.

Optionally, the at least one cut away comprises at least two cutaways. Each of the at least two cutaways is disposed between the two or more arcuate segments.

The fourth aspect of the disclosure provides a blank for forming an article carrier. The blank comprises a main panel having at least one article retention structure for engaging an article. The at least one article retention structure comprises an aperture having a perimeter. The perimeter of the aperture is interrupted by at least one major cutaway and by at least one minor cutaway. The at least one major cutaway comprises a first angular dimension and the at least one minor cutaway comprises a second angular dimension. The first angular dimension is greater in magnitude than the second angular dimension.

Optionally, the perimeter of the aperture includes a load bearing edge for engaging an upper rim of an article to be received in the at least one article retention structure. The load bearing edge extends between the at least one major cutaway and the at least one minor cutaway.

The fifth aspect of the disclosure provides a blank for forming an article carrier. The blank comprises a main panel having at least one article retention structure for engaging an article. The at least one article retention structure comprises an aperture having a perimeter. The perimeter of the aperture is interrupted by at least one cutaway. The radially outermost end of the at least one cutaway is disposed generally at an outer perimeter of an upper rim of an article to be received in the at least one article retention structure.

The sixth aspect of the disclosure provides a blank for forming an article carrier. The blank comprises a main panel having at least one article retention structure for engaging an article. The at least one article retention structure comprises an aperture having a perimeter. The perimeter of the aperture is interrupted by at least two cutaways including at least one major cutaway and at least one minor cutaway. The at least two cutaways are in tangential contact with a notional circle defined by an outer perimeter of an upper rim of an article to be received in the at least one article retention structure.

Further features and advantages of the present disclosure will be apparent from the specific embodiments illustrated in the drawings and discussed below.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the disclosure will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the disclosure can be implemented and do not represent an exhaustive list of all of the ways the disclosure may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the disclosure.

Figure 1:
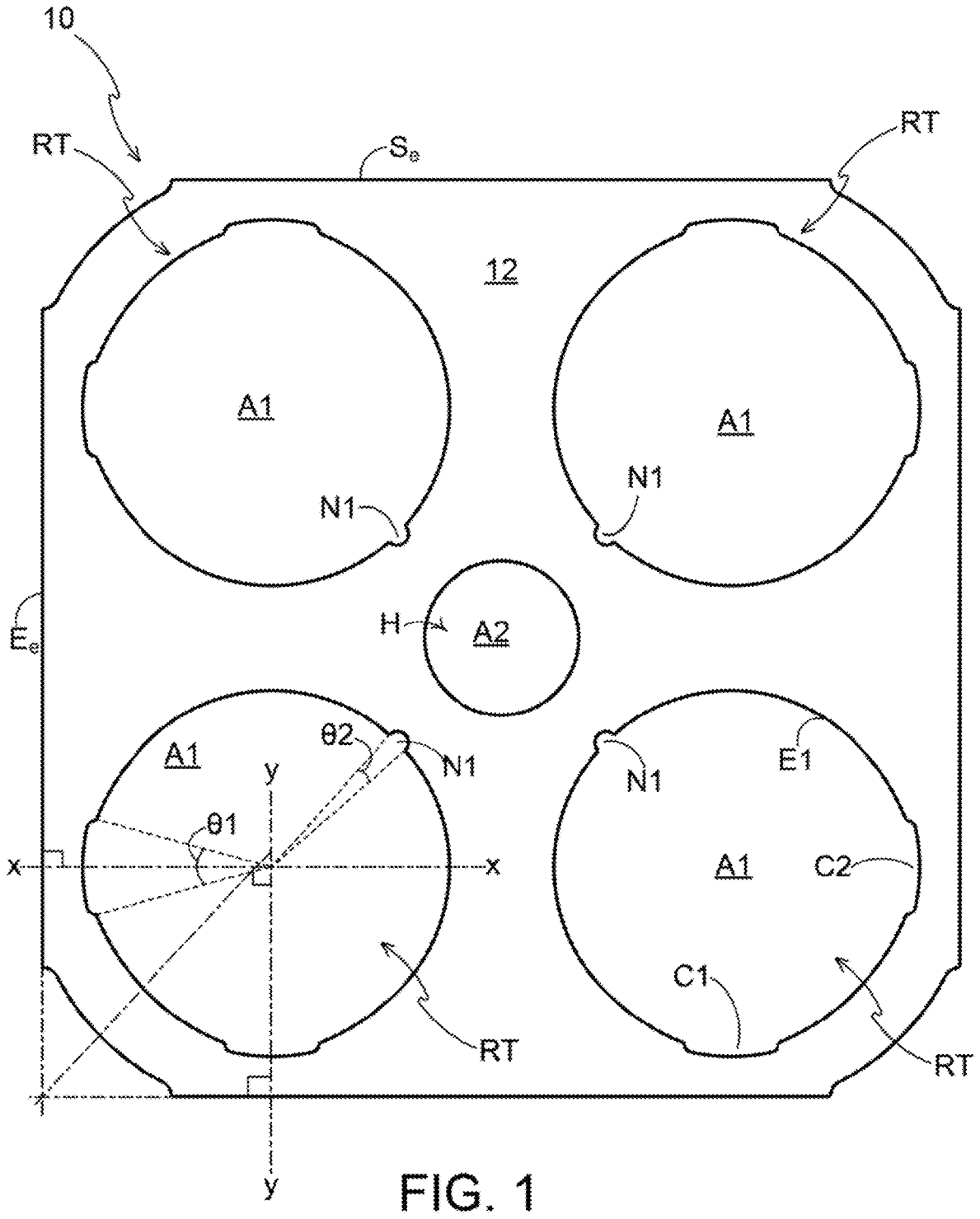
FIG. 1 is a plan view from above of a blank for forming a carrier according to a first embodiment.
Figure 2:
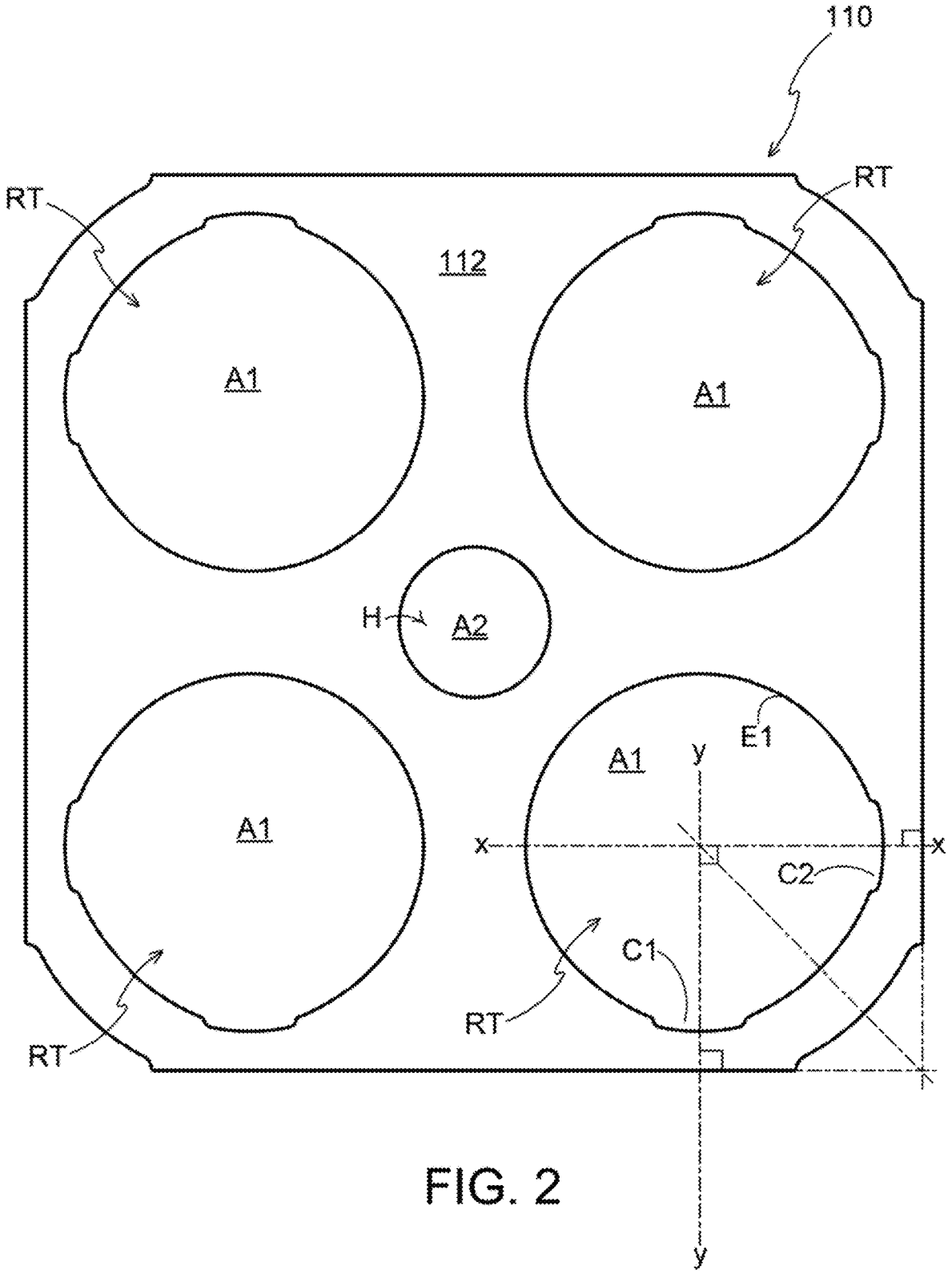
FIG. 2 is a plan view from above of a blank for forming a carrier according to a second embodiment.

Referring to FIG. 1, there is shown a plan view of a blank 10 which is capable of forming a carton or carrier (not shown), as shown in FIG. 2, for containing and carrying a group of primary products such as, but not limited to, bottles or cans, hereinafter referred to as articles B, as shown in FIG. 2. The articles B may be generally cylindrical; the articles B may comprise a circular cross-sectional shape, at least about a region of engagement with the carrier. The blank 10 forms a secondary package for packaging at least one primary product container or package. Alternative blanks 110; 210; 310; 410; 510; 610; 710; 810 are shown in FIGS. 3 to 9B for forming an alternative carton or carrier 190.

In the embodiments detailed herein, the terms "carton" and "carrier" refer, for the non-limiting purpose of illustrating the various features of the disclosure, to a container for engaging and carrying articles, such as primary product containers. It is contemplated that the teachings of the disclosure can be applied to various product containers, which may or may not be tapered and/or cylindrical. Exemplary containers include bottles (for example metallic, glass or plastics bottles), cans (for example aluminium cans), tins, pouches, packets and the like.

The blanks 10; 110; 210; 310; 410; 510; 610; 710; 810 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard or corrugated board, which may be made of or coated with materials to increase its strength. An example of such a sheet material is E- or F-flute corrugated board. Another example may be tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110; 210; 310; 410; 510; 610; 710; 810 are configured to form a carton or carrier 190 for packaging an exemplary arrangement of exemplary articles B. In the embodiments illustrated in FIGS. 1 to 5, the arrangement is a 2×2 matrix or array—two rows of two articles B are provided—and the articles B are beverage cans. In the embodiments illustrated in FIGS. 5A to 9B, the arrangement is a 2×4 matrix or array—two rows of four articles B are provided—and the articles B are beverage cans. Alternatively, the blanks 10; 110; 210; 310; 410; 510; 610; 710; 810 can be configured to form a carrier for packaging other types, number and size of articles and/or for packaging articles in a different arrangement or configuration.

Referring to FIG. 1, there is shown a blank 10 comprising a main panel 12 for forming a top wall or an engaging panel of a carrier (not shown).

The main panel 12 includes at least one article retention structure RT. In the illustrated embodiment, the main panel 12 comprises a plurality of article retention structures RT specifically four article retention structures RT arranged in 2×2 matrix or array. The main panel 12 comprises two columns of article retention structures RT, each column comprises two article retention structures RT. The main panel 12 comprises two rows of article retention structures RT, each row comprises two article retention structures RT. Each of the article retention structures RT may comprise an aperture A1.

Figure 8A:
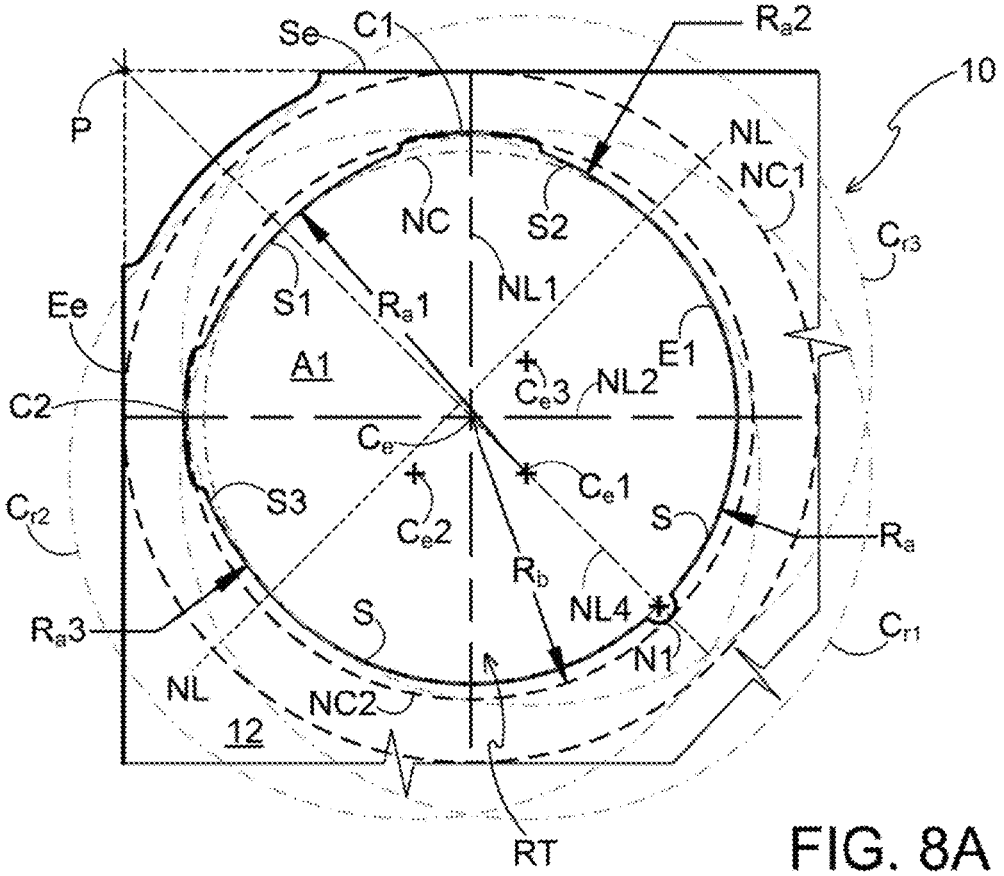
FIG. 8A is an enlarged plan view from above of a portion of the blank of FIG. 1.

Each of the article retention structures RT is substantially similar in construction and will therefore be described in detail with reference to a first one of the article retention structures RT located adjacent to a first end of the blank 10 as shown in FIG. 8A. The article retention structure RT comprises an article receiving opening defined in part by an aperture A1. The article retention structure RT comprises a perimeter or engaging edge E1 defined by the aperture A1. The perimeter E1 is a load bearing edge from which the article B is supported or suspended. The article retention structure RT may comprise at least one cutaway C1, C2, N1 struck from the perimeter of the aperture A1. However, the article retention structure RT of FIG. 8A comprises at least one first or major cutaway C1, C2 and at least one second or minor cutaway N1. The at least one first cutaway C1, C2 is larger than the at least one second cutaway N1. The at least one first cutaway C1, C2 comprises a first angular width or dimension θ1 as shown in FIG. 1. The at least one second cutaway N1 comprises a second angular width or dimension θ2 as shown in FIG. 1. The first angular width or dimension θ1 is greater than the second angular width or dimension θ2. The first angular width or dimension θ1 may be in the range 10° to 45°, may be in the range 20° to 40°, and may be about 31.25°. The second angular width or dimension θ2 may be less than 10°, may be in the range 5° to 30°, may be in the range 5° to 15°, and may be about 7.15°. The first angular width or dimension θ1 may be at least twice the magnitude of the second angular width or dimension θ2, may be between three to six times greater in magnitude, and may be about four times greater in magnitude. Those cutaways C1, C2, N1 reduce application force (or radial stress) which may be applied to the main panel 12 when the carrier blank is applied to articles such as cans. Application force is a critical converting parameter which may be improved significantly with the use of cutaways such as the cutaways C1, C2, N1. Reduction of application force or stress relief become important where tear initiations are likely, such as when the MD alignment of paperboard/corrugated board fibers aligns with the stress propagation vector. FIG. 1 shows an optional example of the locations of the first cutaways C1, C2 where those cutaways may effectively reduce application force on condition that one of notional lines X-X and Y-Y which bisect the cutaways C2, C1 respectively is parallel to the grain/fiber direction of the main panel 12 which may optionally be formed of paperboard or corrugated board.

Referring to FIG. 8A, the perimeter of the aperture A1 comprises four arcuate segments, each of which provides a load bearing edge. A first arcuate segment Sis defined by two circular cut lines each centred at a first centre $C_e$ and having a first radius of curvature $R_a$. In one example, the first radius of curvature $R_a$ may be around 1.001 inches or about 25.4 mm. The first arcuate segment S is interrupted by the at least one second cutaway N1.

A second arcuate segment S1 substantially diagonally opposes the second cutaway N1 and is defined by a circular cut line centred at a second centre $C_e1$ and having a second radius of curvature $R_a1$ defining a second circle $C_{r1}$. In one example, the second radius of curvature $R_a1$ may be around 1.3 inches or about 33 mm. The second centre $C_e1$ lies on a notional line passing through a corner of the main panel 12 (or a notional corner or vertex P defined by extensions of the side and end edges of the main panel 12) and the first centre $C_e$; said notional line may be arranged to define an angle of 45° with the side or end edge of the main panel 12. The second radius of curvature $R_a1$ is greater than the first radius of curvature $R_a$. The second arcuate segment S1 extends between a first major cutaway C1 and a second major cutaway C2.

A third arcuate segment S2 is disposed between the first major cutaway C1 and the first arcuate segment S and defines a transition between the first major cutaway C1 and the first arcuate segment S. The third arcuate segment S2 is defined by a circular cut line centred at a third centre $C_e2$ and having a third radius of curvature $R_a2$ defining a third circle $C_{r2}$. In one example, the third radius of curvature $R_a2$ may be around 1.3 inches or about 33 mm. The third radius of curvature $R_a2$ is greater than the first radius of curvature $R_a$. The third radius of curvature $R_a2$ may be equal to the second radius of curvature $R_a1$.

A fourth arcuate segment S3 is disposed between the second major cutaway C2 and the first arcuate segment S and defines a transition between the second major cutaway C2 and the first arcuate segment S. The fourth arcuate segment S3 is defined by a circular cut line centred at a fourth centre $C_e3$ and having a fourth radius of curvature $R_a3$ defining a fourth circle $C_{r3}$. In one example, the fourth radius of curvature $R_a3$ may be around 1.3 inches or about 33 mm. The fourth radius of curvature $R_a3$ is greater than the first radius of curvature $R_a$. The fourth radius of curvature $R_a3$ may be equal to the second radius of curvature $R_a1$.

FIG. 8A illustrates the position of an article B, in the illustrated embodiment a can, wherein the dashed line NC1 shows the position of the side wall of a main body portion of the article B and indicates the maximum diameter or width of the article B. The position of an upper rim or chime of the article B is indicated by dashed line NC2. When the carrier is applied to the article B, the upper rim of the article B passes through the opening in the main panel 12 provided by the article retention structure RT. The rim may be provided by an end seam such as a canners end seam. The rim comprises a radius of curvature $R_b$. In one example, the rim may have a diameter around 2.1235 inches or about 53.9 mm, the radius of curvature $R_b$ being about 26.9 mm. The main body portion may have a diameter of around 2.6 inches or about 66 mm. The rim radius $R_b$ is greater than the first radius of curvature $R_a$. The aperture A1 and the major and minor cutaways C1, C2, N1 are arranged to be disposed within the footprint of the upper rim of the article B, in FIG. 8A, the aperture A1 and the major and minor cutaways C1, C2, N1 are arranged to be disposed substantially within the circle NC2. In some embodiments, the second radius of curvature $R_a1$, third radius of curvature $R_a2$, and fourth radius of curvature $R_a3$ may be equal to the radius of curvature of the main body portion of the article B to be engaged, the distance between first centre $C_e$ and notional circle NC1 shown in FIG. 8A.

A portion of the second arcuate segment S1 may be coincident or lie on a notional circle NC defined by the first arcuate segment S.

The second notional circle $C_{r1}$ and the third notional circle $C_{r2}$ intersect at a midpoint of the first major cutaway C1, the midpoint of the first major cutaway C1 and the first centre $C_e$ defining a notional line NL1 perpendicular to a first or side edge "Se" of the main panel 12. The intersection between second circle $C_{r1}$ and the third circle $C_{r2}$ may lie upon an edge of the aperture A1 defined by the first cutaway C1. The intersection between second circle $C_{r1}$ and the third circle $C_{r2}$ may lie upon a vertex or intersection between the notional line NL1 perpendicular to the side edge "Se" of the main panel 12 and the circle NC2 defining the location of the rim of the article B.

The second circle $C_{r1}$ and the fourth circle $C_{r3}$ intersect at a midpoint of the second cutaway C2, the midpoint of the second cutaway C2 and the first centre $C_e$ defining a notional line NL2 perpendicular to a second or end edge "Ee" of the main panel 12. The intersection between second circle $C_{r1}$ and the fourth circle $C_{r3}$ may lie upon an edge of the aperture A1 defined by the second cutaway C2. The intersection between second circle $C_{r1}$ and the fourth circle $C_{r3}$ may lie upon a vertex or intersection between the notional line NL2 perpendicular to the end edge "Ee" of the main panel 12 and the circle NC2 defining the location of the rim of the article B.

The minor cutaway N1 is centred on a notional line NL4 passing through the first centre $C_e$ and the corner of the main panel 12 (or a notional corner or vertex P defined by extensions of the side and end edges "Se", "Ee" of the main panel 12).

The centres or midpoints of the first and second major cutaways C1, C2 are orthogonally arranged and are spaced equidistant about the notional line NL4 passing through a corner of the main panel 12 (or a notional corner or vertex P defined by extensions of the side and end edges "Se", "Ee" of the main panel 12). Stated differently, the notional line NL4 defines an axis of symmetry about which the major cutaways C1, C2 are disposed symmetrically. In an alternative embodiment or optionally, the major cutaways C1, C2 may be asymmetrically arranged about the notional line NL4.

The opposite terminal ends of the first arcuate segment S define a notional line NL-NL; the notional line NL-NL defines locations on the perimeter E1 of the aperture A1 where the radius of curvature changes. Stated differently and as viewed in FIG. 8A, that portion of the perimeter E1 on the lower-right side of the notional line NL-NL comprises a first load bearing edge having the first radius of curvature Ra while that portion of the perimeter E1 on the upper-left side of the notional line NL-NL comprises a second load bearing edge having the second radius of curvature Ra1, Ra2 or Ra3. The first load bearing edge or first arcuate segment S is divided by the minor cutaway N1 into two portions. The second load bearing edge is divided by the first and second major cutaways C1, C2 into the three arcuate segments S1, S2, S3 having the respective (or different) centers Ce1, Ce2, Ce3 of curvature spaced apart from one another. The notional line NL-NL is disposed between the first centre $C_e$ and the corner of the main panel 12 (or a notional corner or vertex P defined by extensions of the side and end edges of the main panel 12). The notional line NL-NL is disposed between the first centre $C_e$ and the major cutaway C1, C2. In some embodiments, the notional line NL-NL may pass through the first centre $C_e$.

Referring again to FIG. 1, the minor cutaways N1 of the article retention structures RT are located about the apertures A1 at a location in closest proximity to an optional handle opening A2 forming a carrying handle H. The handle opening A2 is centrally struck from the main panel 12 and is disposed centrally of the group of four article retention structures RT provided in the main panel 12.

Optionally, each minor cutaway N1 may be defined by an arcuate edge having a radius of curvature. In an alternative embodiment or further optionally, each minor cutaway N1 may be defined by multiple linear edges angularly disposed with respect to each other to form, for example, a half a hexagon, octagon, etc.

Referring now to FIGS. 2 to 9B, there are shown additional embodiments of the present disclosure. In the second, third, fourth and fifth illustrated embodiments like numerals have, where possible, been used to denote like parts, albeit with the addition of the prefix "100", "200", "300", "400", "500", "600", "700", "800" to indicate that these features belong to the second, third, fourth, fifth, sixth, seventh, eighth, and ninth embodiment respectively. The additional embodiments share many common features with the first embodiment and therefore only the differences from the embodiment illustrated in FIGS. 1 and 2 will be described in detail.

Figure 3:
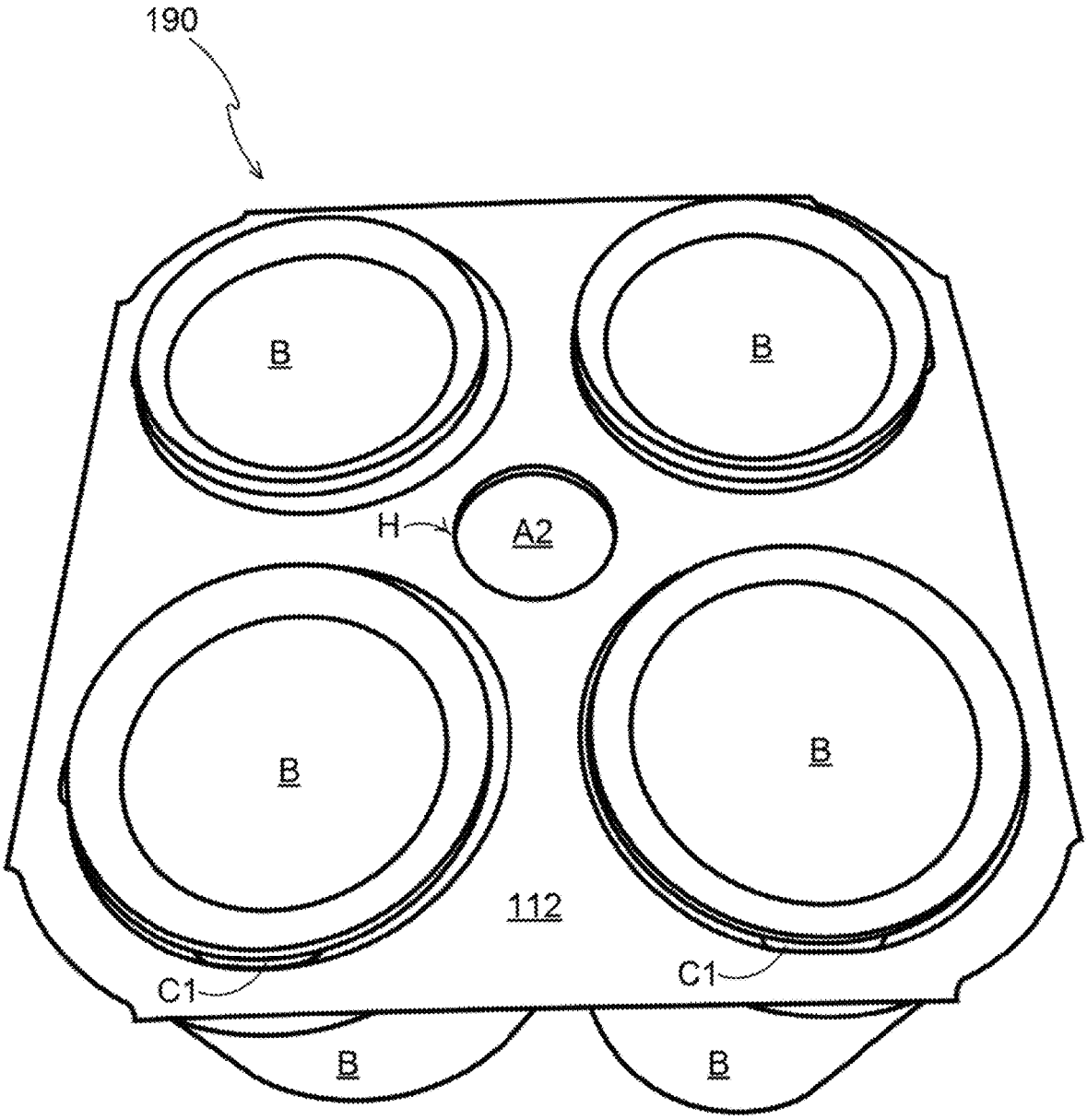
FIG. 3 is a perspective view from above of a carrier formed from the blank of FIG. 2.

Referring to FIG. 2 there is shown a blank 110 comprising a main panel 112 for forming a top wall or an engaging panel of a carrier 190 (see FIG. 3).

The main panel 112 includes at least one article retention structure RT. In the illustrated embodiment, the main panel 112 comprises a plurality of article retention structures RT specifically four article retention structures RT arranged in 2×2 matrix or array. The main panel 112 comprises two columns of article retention structures RT, each column comprises two article retention structures RT. The main panel 112 comprises two rows of article retention structures RT, each row comprises two article retention structures RT. Each of the article retention structures RT may comprise an aperture A1.

Each of the article retention structures RT is substantially similar in construction to the article retention structures RT of FIG. 1 albeit with the omission of the minor cutaway or notch N1 and therefore will not be described in further detail.

Figure 10:
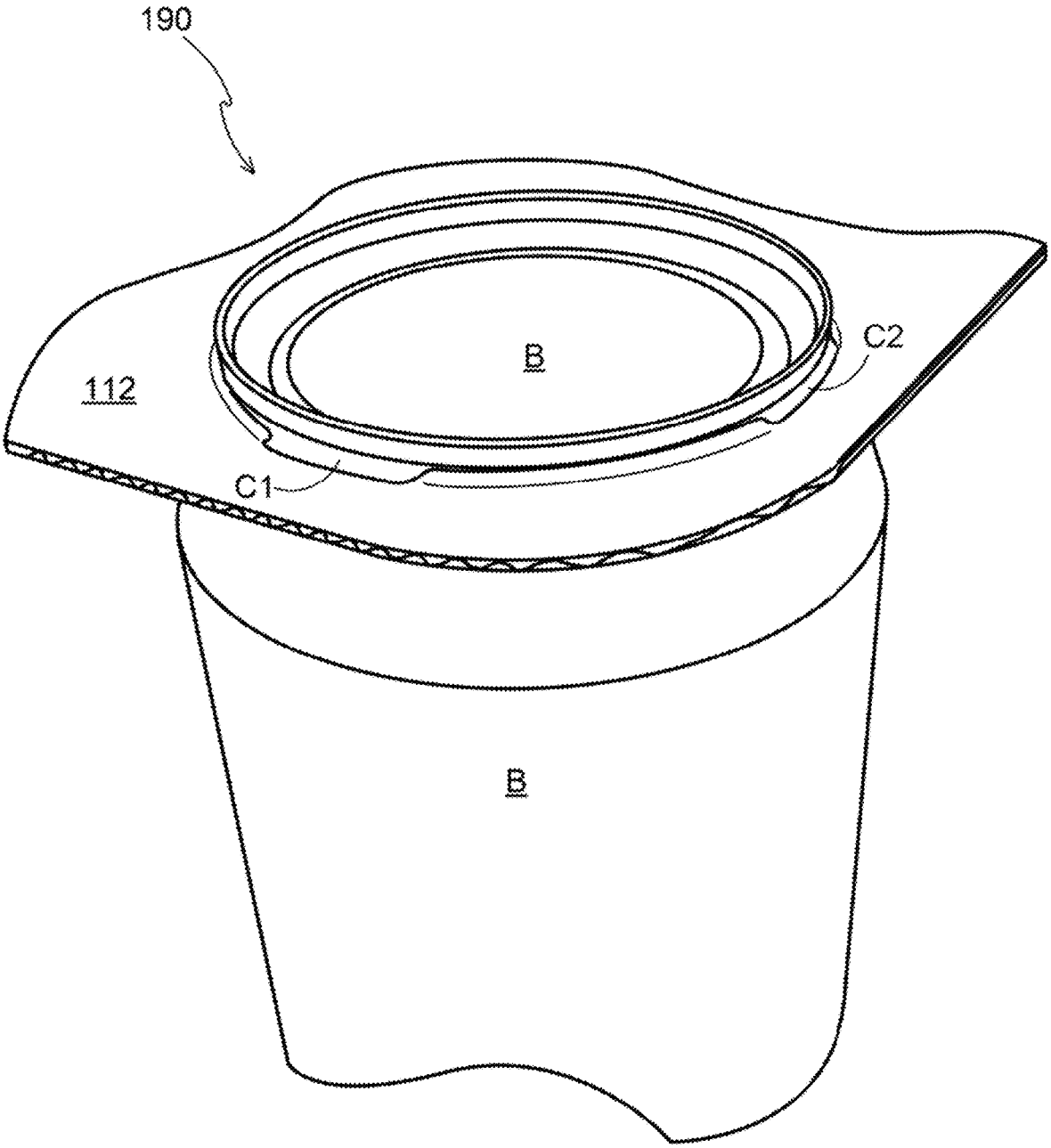
FIG. 10 is an enlarged perspective view from above of a portion of the carrier of FIG. 3.

FIG. 3 shows a carrier 190 formed from the blank 110, an article B has been received in each of the article retention structures RT, a region of the main panel 112 disposed about the apertures A1 may be deformed or displaced outwardly to accommodate the article B. The deformed or displaced or displaced region may be interrupted by the cutaways C1, C2. FIG. 10 shows an enlarged view of an article B received in an article retention structure RT, the cutaways C1, C2, allow the article B to be received whilst minimising creasing, cracking, or tearing of the main panel 112, in particular creases, cracks or tears propagating outwardly, generally radially, from the aperture A1. The main panel 112 outside of an annular region surrounding the apertures A1 remains generally planar when the articles B are at rest upon a surface.

Figure 4:
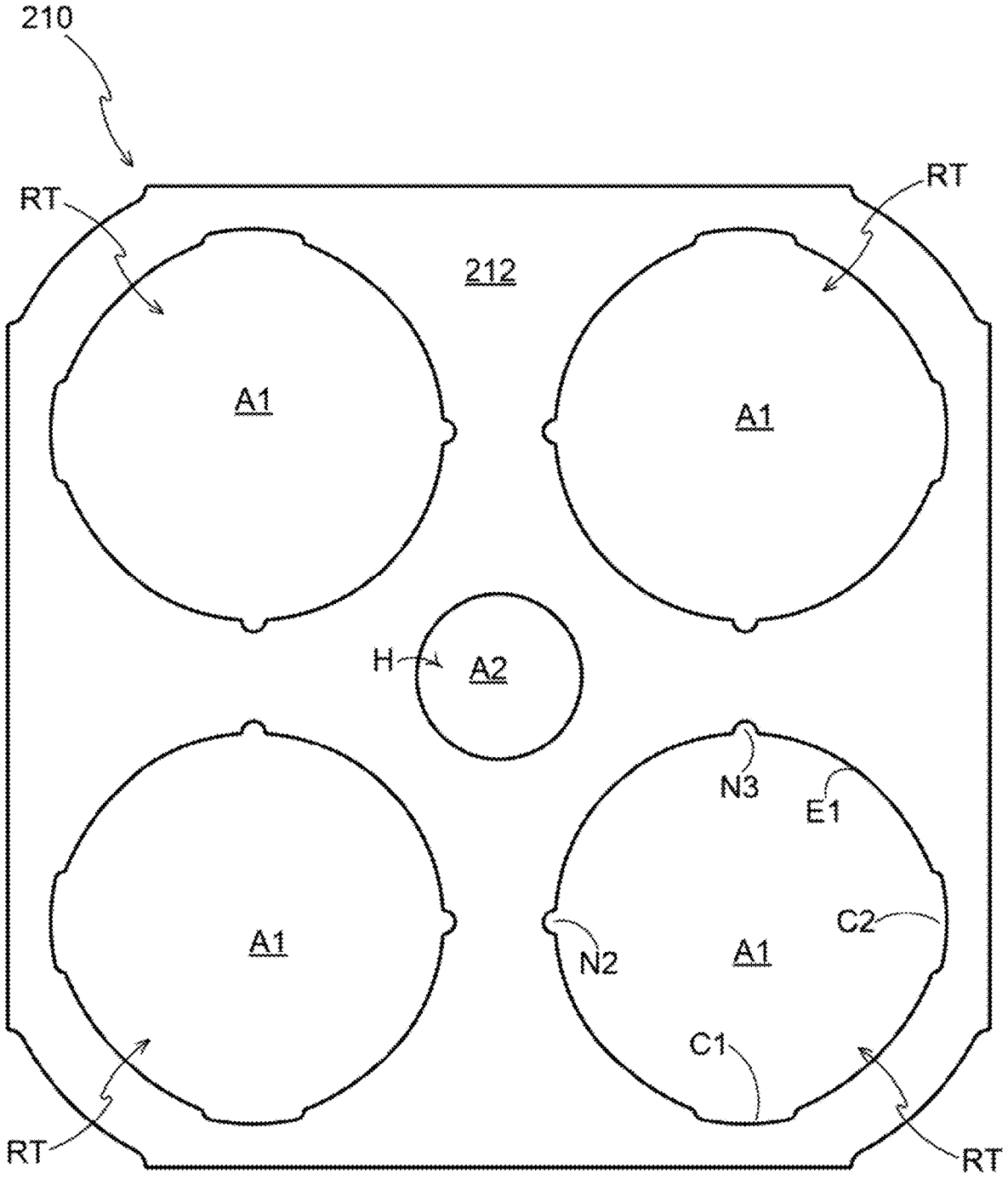
FIG. 4 is a plan view from above of a blank for forming a carrier according to a third embodiment.

Referring to FIG. 4 there is shown a blank 210 comprising a main panel 212 for forming a top wall or an engaging panel of a carrier (not shown).

The main panel 212 includes at least one article retention structure RT. In the illustrated embodiment, the main panel 212 comprises a plurality of article retention structures RT specifically four article retention structures RT arranged in 2×2 matrix or array. The main panel 212 comprises two columns of article retention structures RT, each column comprises two article retention structures RT. The main panel 212 comprises two rows of article retention structures RT, each row comprises two article retention structures RT. Each of the article retention structures RT may comprise an aperture A1.

Figure 8B:
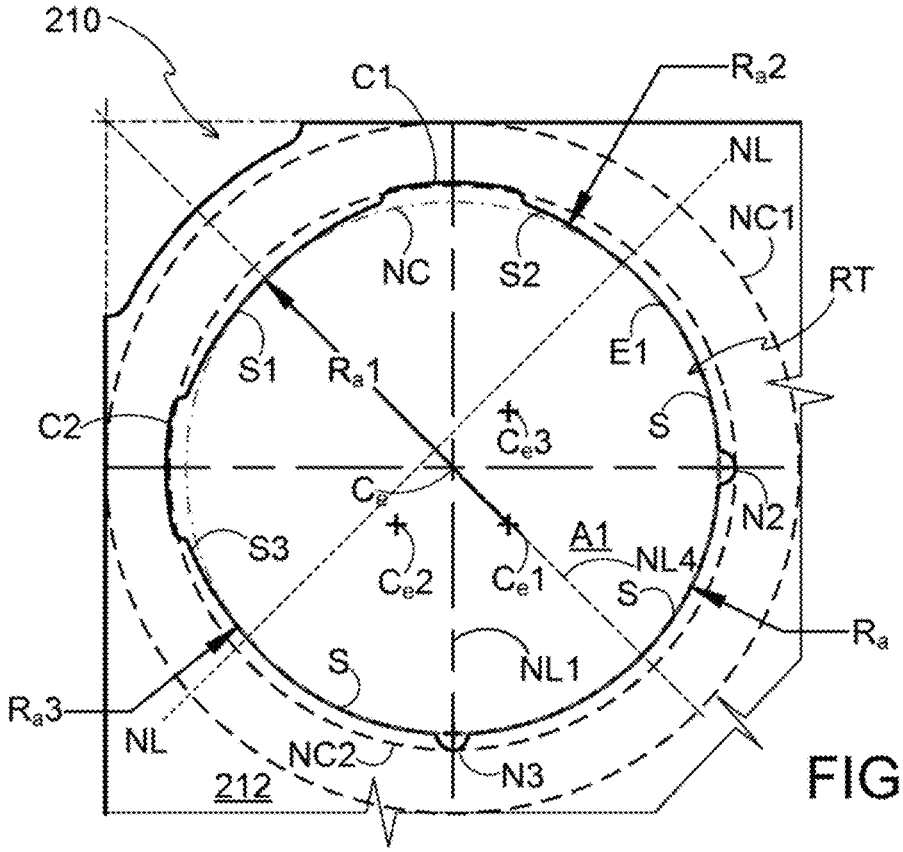
FIG. 8B is an enlarged plan view from above of a portion of the blank of FIG. 4.

Each of the article retention structures RT is substantially similar in construction to the article retention structures RT of FIG. 1 albeit with the inclusion of a second minor cutaway or notch. The article retention structures RT comprise a first minor cutaway or notch N2 and second minor cutaway or notch N3, best shown in FIG. 8B. The first minor cutaway or notch N2 is disposed diagonally opposite the second major cutaway C2. The second minor cutaway or notch N3 is disposed diagonally opposite the first major cutaway C1. The first minor cutaway or notch N2 is disposed orthogonally with respect to the second minor cutaway or notch N3. In FIG. 8B, the notional line NL4 defines an axis of symmetry about which the major and minor cutaways C1, C2, N2, N3 are disposed symmetrically. In an alternative embodiment or optionally, the major and minor cutaways C1, C2, N2, N3 may be asymmetrically arranged about the notional line NL4.

The first minor cutaway or notch N2 is disposed in back-to-back relationship with the first minor cutaway or notch N2 of a first adjacently disposed article retention structure RT, best shown in FIG. 4.

The second minor cutaway or notch N3 is disposed in back-to-back relationship with the second minor cutaway or notch N3 of a second adjacently disposed article retention structure RT. The first load bearing edge or first arcuate segment S of the perimeter E1 is divided by the first and second minor cutaway N2, N3 into three portions.

Figure 5A:
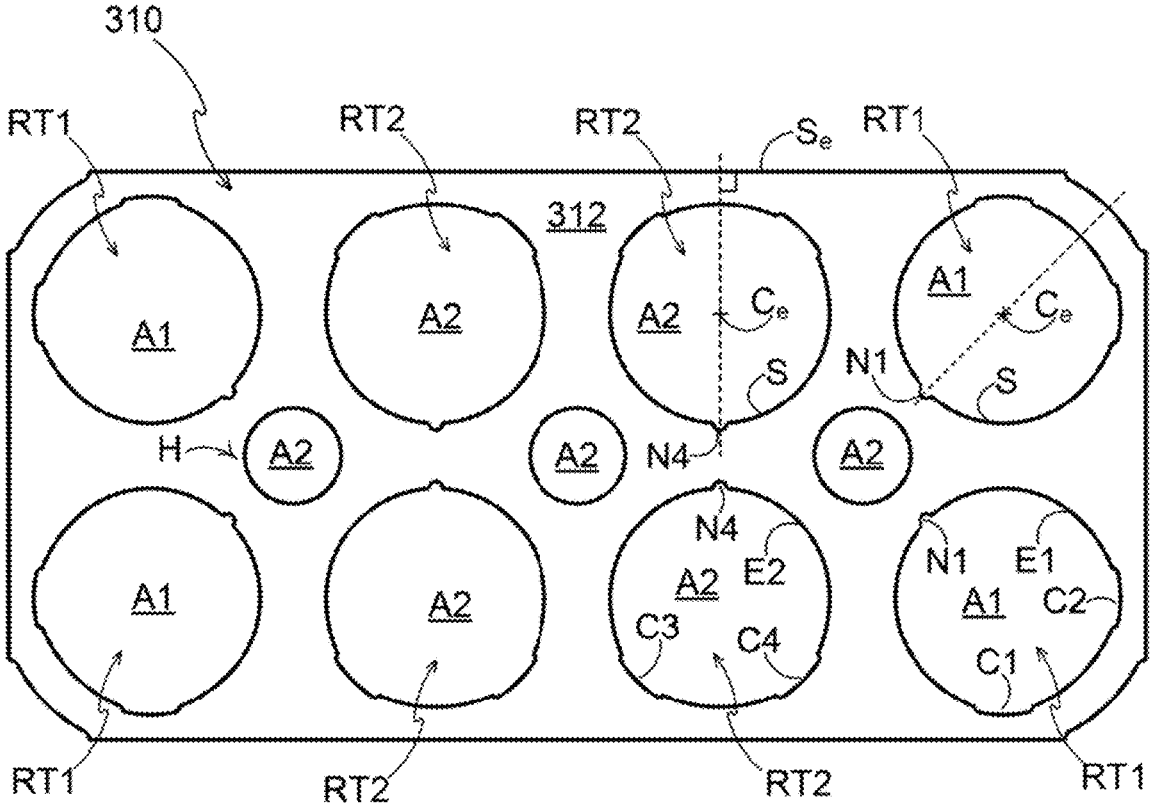
FIG. 5A is a plan view from above of a blank for forming a carrier according to a fourth embodiment.

Referring to FIG. 5A there is shown a blank 310, according to a fourth embodiment, comprising a main panel 312 for forming a top wall or an engaging panel of a carrier (not shown).

The main panel 312 includes at least one article retention structure RT1, RT2. In the illustrated embodiment, the main panel 312 comprises a plurality of article retention structures RT1, RT2 specifically eight article retention structures RT1, RT2 arranged in 2×4 matrix or array. The main panel 312 comprises four columns of article retention structures RT, each column comprises two article retention structures RT1, RT2. The main panel 312 comprises two rows of article retention structures RT1, RT2, each row comprises four article retention structures RT1, RT2. Each of the article retention structures RT1, RT2 may comprise an aperture A1, A2.

The blank 310 comprises four first article retention structures RT1. The first article retention structures RT1 are located adjacent to ends of the main panel 312. The blank 310 comprises four second article retention structures RT2. The second article retention structures RT2 are located between a first pair of first article retention structures RT1 disposed proximate a first end of the main panel 312 and a second pair of first article retention structures RT1 disposed proximate a second end of the main panel 312. The second article retention structures RT2 are also referred to herein as intermediate article retention structures RT2. The first article retention structures RT1 are also referred to herein as end article retention structures RT1.

Each of the first article retention structures RT1 is substantially similar in construction to the article retention structures RT of the embodiment shown in FIGS. 1 and 8A and will not be described in further detail.

Each of the second article retention structures RT2 is substantially similar in construction to the first article retention structures RT1 albeit the orientation of the second article retention structure RT2 has been changed with respect to the first article retention structures RT1. The second article retention structures RT2 are rotated through an angle of 45° such that the notional line which passes through the centre of the minor cutaway N4 and the centre $C_e$ of the first arcuate segment S is perpendicular to a longitudinal or side edge "Se" of the main panel 312.

The main panel 313 may comprise a plurality of handle openings A2. The illustrated embodiment comprises three handle openings A2. Each handle opening is disposed centrally of a group of four article retention structures RT1, RT2.

Figure 5B:
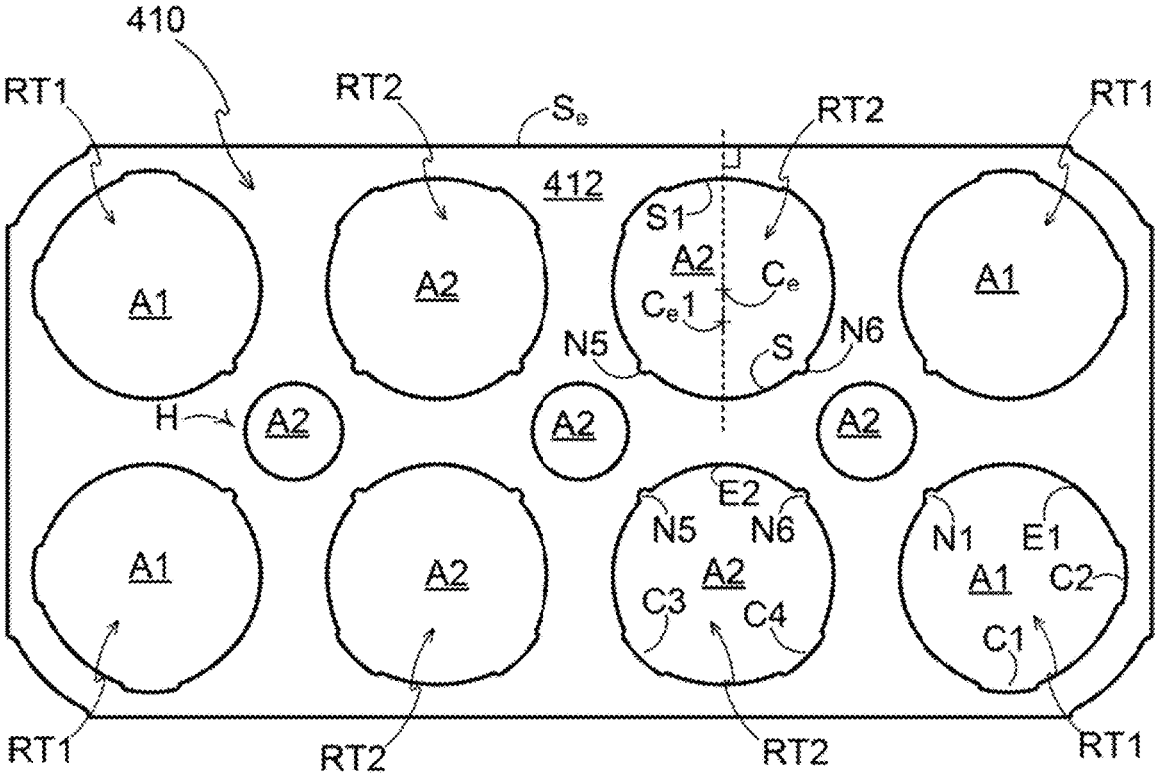
FIG. 5B is a plan view from above of a blank for forming a carrier according to a fifth embodiment.

Referring to FIG. 5B there is shown a blank 410, according to a fifth embodiment, comprising a main panel 412 for forming a top wall or an engaging panel of a carrier (not shown).

The main panel 412 includes at least one article retention structure RT1, RT2. In the illustrated embodiment, the main panel 412 comprises a plurality of article retention structures RT1, RT2 specifically eight article retention structures RT1, RT2 arranged in 2×4 matrix or array. The main panel 412 comprises four columns of article retention structures RT, each column comprises two article retention structures RT1, RT2. The main panel 412 comprises two rows of article retention structures RT1, RT2, each row comprises four article retention structures RT1, RT2. Each of the article retention structures RT1, RT2 may comprise an aperture A1, A2.

Each of the first article retention structures RT1 is substantially similar in construction to the article retention structures RT of the embodiment shown in FIGS. 1 and 8A and will not be described in further detail.

Each of the second article retention structures RT2 is substantially similar in construction to the article retention structures RT of the embodiment shown in FIGS. 4 and 8B albeit the orientation of the second article retention structure RT2 has been changed with respect to the article retention structure RT in FIGS. 4 and 8B. The second article retention structures RT2 are rotated through an angle of 45° such that the notional line which passes through the centre $C_e$ of the first load bearing edge or first arcuate segment S and the centre $C_e1$ of the second arcuate segment S1 is perpendicular to a longitudinal or side edge "Se" of the main panel 412.

Figure 6A:
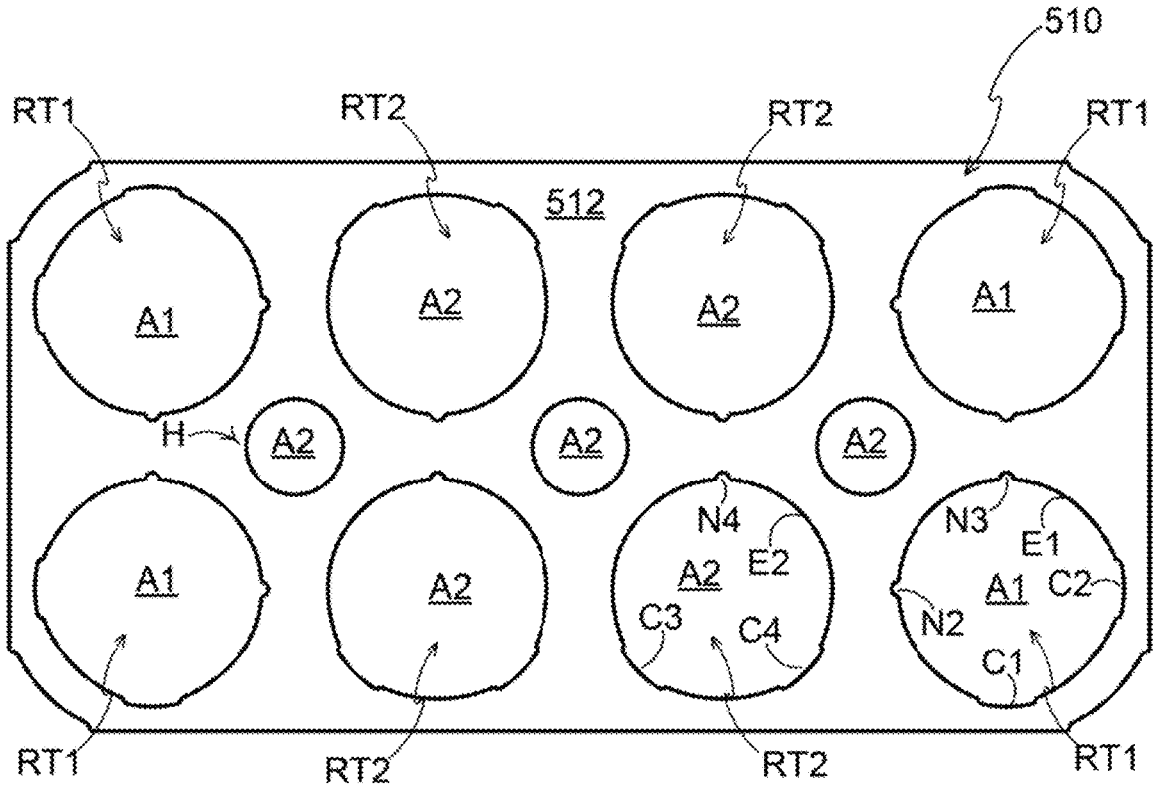
FIG. 6A is a plan view from above of a blank for forming a carrier according to a sixth embodiment.

Referring to FIG. 6A there is shown a blank 510, according to a sixth embodiment, comprising a main panel 512 for forming a top wall or an engaging panel of a carrier (not shown).

The main panel 512 includes at least one article retention structure RT1, RT2. In the illustrated embodiment, the main panel 512 comprises a plurality of article retention structures RT1, RT2 specifically eight article retention structures RT1, RT2 arranged in 2×4 matrix or array. The main panel 512 comprises four columns of article retention structures RT, each column comprises two article retention structures RT1, RT2. The main panel 512 comprises two rows of article retention structures RT1, RT2, each row comprises four article retention structures RT1, RT2. Each of the article retention structures RT1, RT2 may comprise an aperture A1, A2.

The blank 510 comprises four first article retention structures RT1. The first article retention structures RT1 are located adjacent to ends of the main panel 512. The blank 510 comprises four second article retention structures RT2. The second article retention structures RT2 are located between a first pair of first article retention structures RT1 disposed proximate a first end of the main panel 512 and a second pair of first article retention structures RT1 disposed proximate a second end of the main panel 512. The second article retention structures RT2 are also referred to herein as intermediate article retention structures RT2. The first article retention structures RT1 are also referred to herein as end article retention structures RT1.

Each of the first article retention structures RT1 is substantially similar in construction to the article retention structures RT of the embodiment shown in FIGS. 4 and 8B and will not be described in further detail.

Each of the second article retention structures RT2 is substantially similar in construction to the second article retention structure RT2 of the embodiment of FIG. 5A and will not be described in further detail.

Figure 6B:
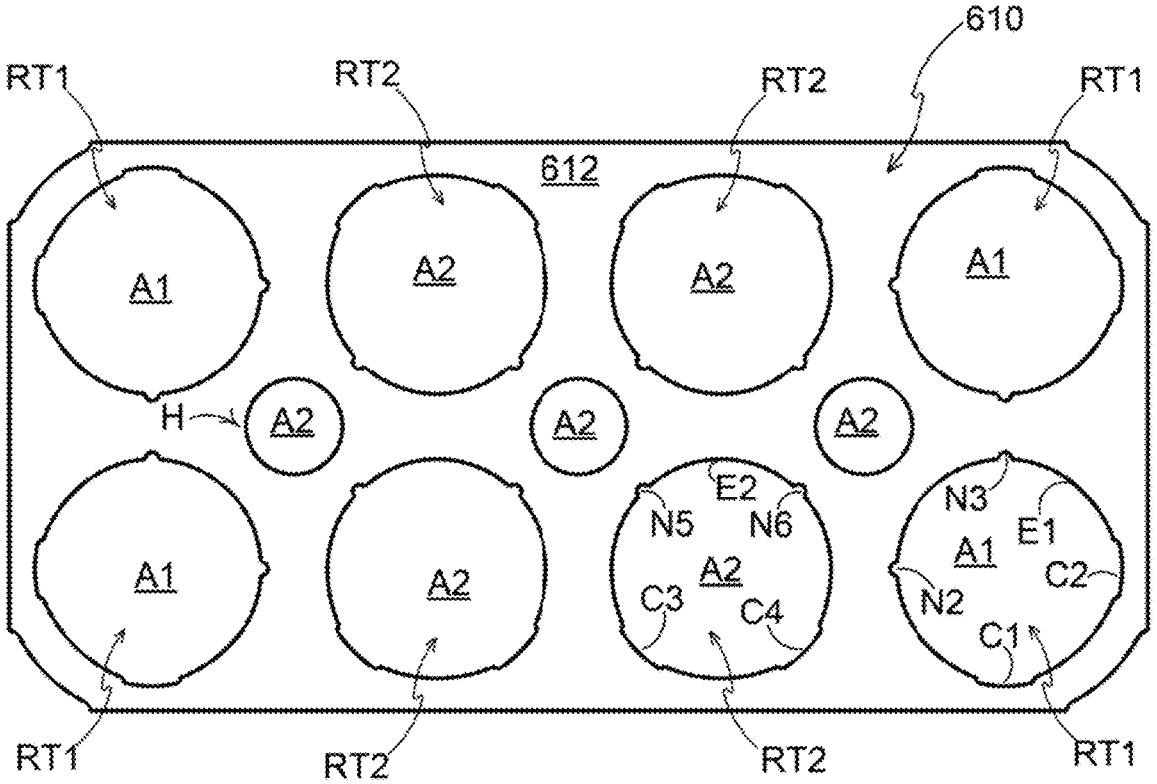
FIG. 6B is a plan view from above of a blank for forming a carrier according to a seventh embodiment.

Referring to FIG. 6B there is shown a blank 610, according to a seventh embodiment, comprising a main panel 612 for forming a top wall or an engaging panel of a carrier (not shown).

The main panel 612 includes at least one article retention structure RT1, RT2. In the illustrated embodiment, the main panel 612 comprises a plurality of article retention structures RT1, RT2 specifically eight article retention structures RT1, RT2 arranged in 2×4 matrix or array. The main panel 612 comprises four columns of article retention structures RT, each column comprises two article retention structures RT1, RT2. The main panel 612 comprises two rows of article retention structures RT1, RT2, each row comprises four article retention structures RT1, RT2. Each of the article retention structures RT1, RT2 may comprise an aperture A1, A2.

Each of the first article retention structures RT1 is substantially similar in construction to the article retention structures RT of the embodiment shown in FIGS. 4 and 8B and will not be described in further detail.

Each of the second article retention structures RT2 is substantially similar in construction to the second article retention structure RT2 of the embodiment of FIG. 5B and will not be described in further detail.

Figure 7A:
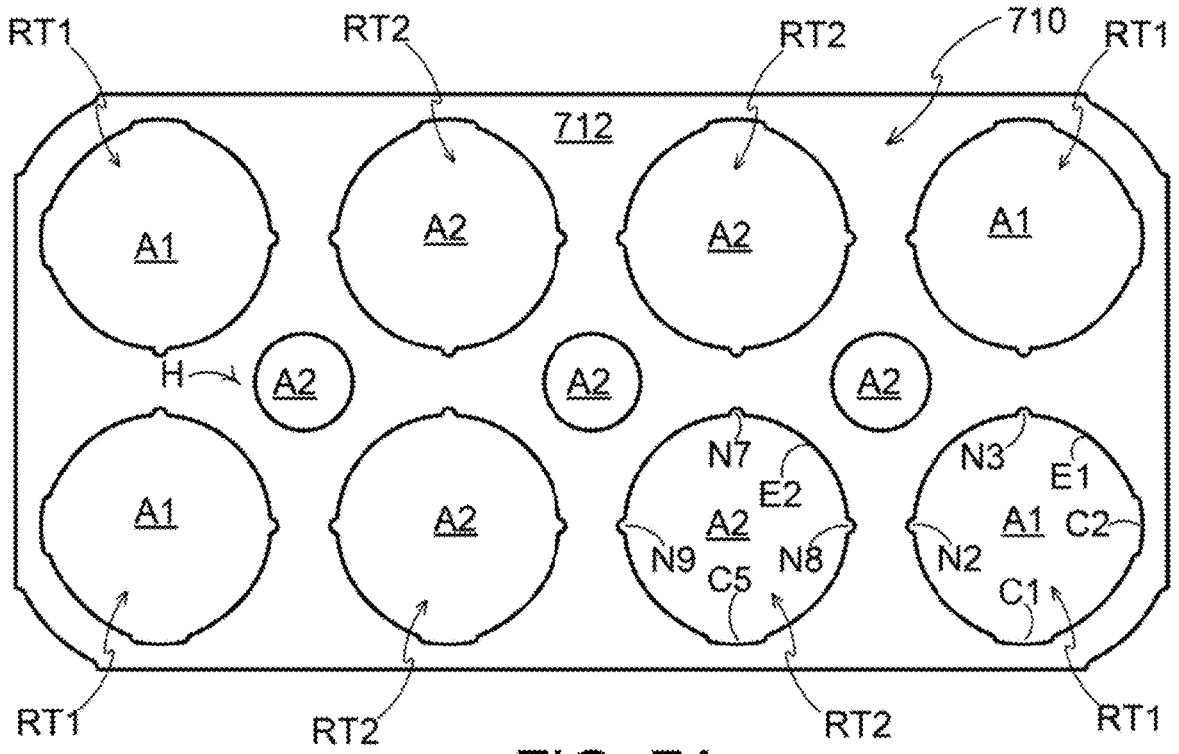
FIG. 7A is a plan view from above of a blank for forming a carrier according to an eighth embodiment.
Figure 7B:
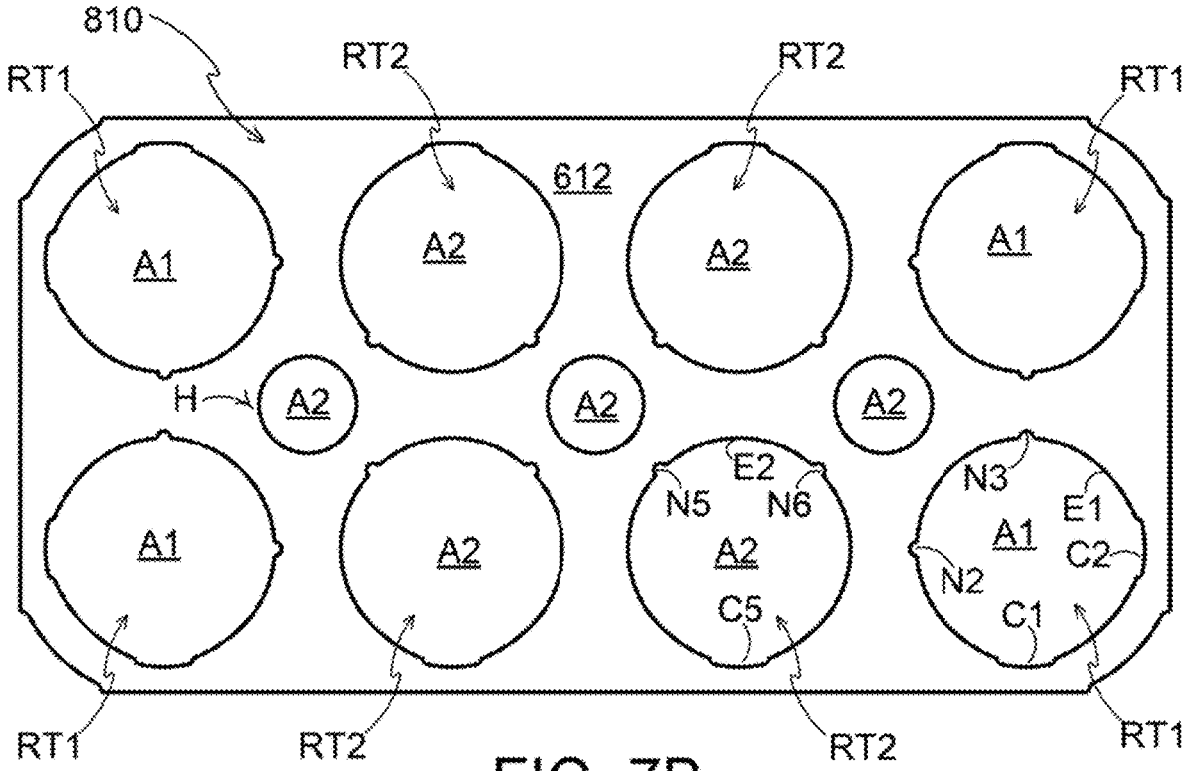
FIG. 7B is a plan view from above of a blank for forming a carrier according to a ninth embodiment.

Referring to FIG. 7A there is shown a blank 710, according to an eighth embodiment, comprising a main panel 712 for forming a top wall or an engaging panel of a carrier (not shown).

The main panel 712 includes at least one article retention structure RT1, RT2. In the illustrated embodiment, the main panel 712 comprises a plurality of article retention structures RT1, RT2 specifically eight article retention structures RT1, RT2 arranged in 2×4 matrix or array. The main panel 712 comprises four columns of article retention structures RT, each column comprises two article retention structures RT1, RT2. The main panel 712 comprises two rows of article retention structures RT1, RT2, each row comprises four article retention structures RT1, RT2. Each of the article retention structures RT1, RT2 may comprise an aperture A1, A2.

The blank 710 comprises four first article retention structures RT1. The first article retention structures RT1 are located adjacent to ends of the main panel 712. The blank 710 comprises four second article retention structures RT2. The second article retention structures RT2 are located between a first pair of first article retention structures RT1 disposed proximate a first end of the main panel 712 and a second pair of first article retention structures RT1 disposed proximate a second end of the main panel 712. The second article retention structures RT2 are also referred to herein as intermediate article retention structures RT2. The first article retention structures RT1 are also referred to herein as end article retention structures RT1.

Each of the first article retention structures RT1 is substantially similar in construction to the article retention structures RT of the embodiment shown in FIGS. 4 and 8B and will not be described in further detail.

Each of the second article retention structures RT2 is substantially similar in construction and will be described in further detail with reference to the second article retention structure RT2 illustrated in FIG. 9A. The second article retention structure RT2 comprises an article receiving opening defined in part by a second aperture A2. The second article retention structure RT2 comprises a perimeter E2 defined by the second aperture A2. The perimeter E2 is a load bearing edge from which the article B is supported or suspended. The second article retention structure RT2 comprises at least one cutaway C5, N7, N8, N9 struck from the perimeter of the second aperture A2. The second article retention structure RT2 of FIG. 9A comprises first or major cutaway C5 and at least one second or minor cutaway N7, N8, N9. The illustrated embodiment comprises three minor cutaways N7, N8, N9. The first cutaway C5 is larger than the at least one second cutaway N7, N8, N9. The first cutaway C5 comprises a first angular width or dimension. The at least one second cutaway N7, N8, N9 comprises a second angular width or dimension. The first angular width or dimension is greater than the second angular width or dimension. The first angular width or dimension may be in the range 10° to 45° and may be about 31.25°. The second angular width or dimension may be less than 10°, may be in the range 5° to 30° and may be about 7.15°. The first angular width or dimension may be at least twice the magnitude of the second angular width or dimension and may be about three or four times greater in magnitude.

A first minor cutaway N7 diagonally opposes the major cutaway C5. A second minor cutaway N8 diagonally opposes a third cutaway N9. The second and third minor cutaways N8, N9 each is disposed orthogonally with respect to the first minor cutaway N7 and the major cutaway C5.

The aperture A2 comprises three arcuate segments. A first arcuate segment S is defined by four circular cut lines each centred at a first centre $C_e$ and having a first radius of curvature $R_a$ defining a first notional circle NC. The first arcuate segment S is interrupted by the three minor or second cutaways N7, N8, N9.

A notional line passing through the centre $C_e$ and through a centre or midpoint of the major cutaway C5 is perpendicular to a side edge "Se" of the main panel 712.

A second arcuate segment S5 provides a transition between the first arcuate segment S and the major cutaway C5. The second arcuate segment S5 is defined by a circular cut line centred at a second centre $C_e5$ and having a second radius of curvature $R_a5$ defining a second notional circle $C_{r5}$. The second radius of curvature $R_a5$ is greater than the first radius of curvature $R_a$.

A third arcuate segment S6 provides a transition between the first arcuate segment S and the major cutaway C5. The third arcuate segment S6 is defined by a circular cut line centred at a third centre $C_e6$ and a third radius of curvature $R_a6$ defining a third notional circle $C_{r6}$. The third radius of curvature $R_a6$ is greater than the first radius of curvature $R_a$. The third radius of curvature $R_a6$ may be equal to the second radius of curvature $R_a5$.

A point of intersection between the first notional circle NC and the second notional circle $C_{r5}$ and a point of intersection between the first circle NC and the third notional circle $C_{r6}$ defines a notional line NL-NL extending parallel to the side edge "Se" of the main panel 712. As viewed in FIG. 9A, that portion of the perimeter E2 of the aperture A2 above the notional line NL-NL deviates from being circular. Stated differently, that portion of the perimeter E2 below the notional line NL-NL comprises a first load bearing edge having the first, smaller radius of curvature Ra while that portion of the perimeter E2 above the notional line NL-NL comprises a second load bearing edge having the greater radius of curvature Ra5, Ra6 having the respective centers Ce5, Ce6 spaced apart from each other. The notional line NL-NL is disposed between the first centre $C_e$ and the major cutaway C5.

The centres of the cutaways C5, N7, N8, N9 define quadrants I, II, III, IV of the first circle NC. First and second quadrants I, II are disposed in closest proximity to the side or longitudinal edge "Se" of the main panel 712. Third and fourth quadrants III, IV are disposed in distally from the side or longitudinal edge "Se" of the main panel 712. The second centre $C_e5$ is disposed in the third quadrant III. The third centre $C_e6$ is disposed in the fourth quadrant IV.

Figure 9A:
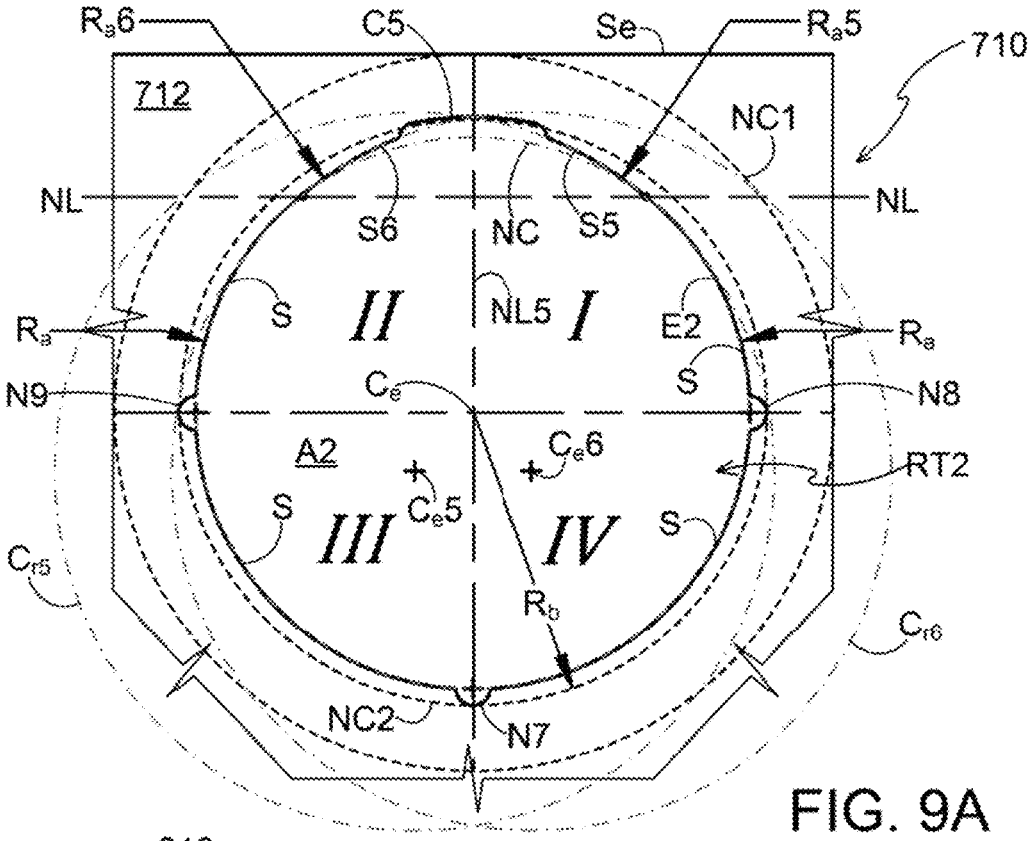
FIG. 9A is an enlarged plan view from above of a portion of the blank of FIG. 7A.

FIG. 9A illustrates the position of an article B, in the illustrated embodiment a can, wherein the dashed line NC1 shows the position of the side wall of a main body portion of the article B and indicates the maximum diameter or width of the article B. The position of a rim or chime of the article B is indicated by dashed line NC2, the rim of the article B passes through the opening in the main panel 712 provided by the second article retention structure RT2. The rim may be provided by an end seam such as a canners end seam. The rim comprises a radius of curvature $R_b$. The rim radius $R_b$ is greater than the first radius of curvature $R_a$. The second aperture A2 and the major and minor cutaways C5, N7, N8, N9 are arranged to be disposed within the footprint of the rim of the article B, in FIG. 9A the second aperture A2 and the major and minor cutaways C5, N7, N8, N9 are arranged to be disposed substantially within the circle NC2.

The second circle $C_{r5}$ and the third circle $C_{r6}$ intersect at a midpoint of the first cutaway C5, the midpoint of the first cutaway C1 and the first centre $C_e$ define a notional line perpendicular to a first or end edge of the main panel 712.

The first minor cutaway N7 is centred on a notional line passing through the first centre $C_e$ and the midpoint of the first cutaway C5.

Figure 9B:
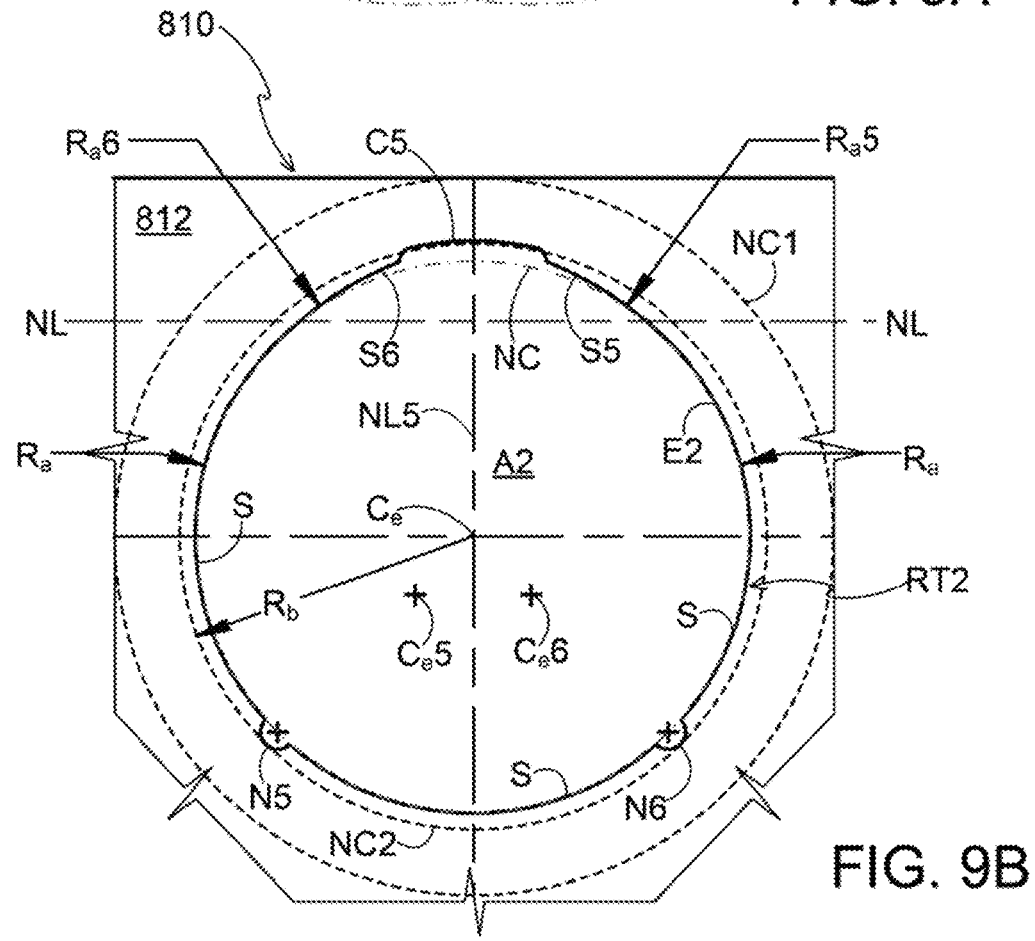
FIG. 9B is an enlarged plan view from above of a portion of the blank of FIG. 7B.

Referring to FIG. 9B there is shown a blank 810, according to a ninth embodiment, comprising a main panel 812 for forming a top wall or an engaging panel of a carrier (not shown).

The main panel 812 includes at least one article retention structure RT1, RT2. In the illustrated embodiment, the main panel 812 comprises a plurality of article retention structures RT1, RT2 specifically eight article retention structures RT1, RT2 arranged in 2×4 matrix or array. The main panel 812 comprises four columns of article retention structures RT, each column comprises two article retention structures RT1, RT2. The main panel 812 comprises two rows of article retention structures RT1, RT2, each row comprises four article retention structures RT1, RT2. Each of the article retention structures RT1, RT2 may comprise an aperture A1, A2.

The blank 810 comprises four first article retention structures RT1. The first article retention structures RT1 are located adjacent to ends of the main panel 812. The blank 810 comprises four second article retention structures RT2. The second article retention structures RT2 are located between a first pair of first article retention structures RT1 disposed proximate a first end of the main panel 812 and a second pair of first article retention structures RT1 disposed proximate a second end of the main panel 812. The second article retention structures RT2 are also referred to herein as intermediate article retention structures RT2. The first article retention structures RT1 are also referred to herein as end article retention structures RT1.

Each of the first article retention structures RT1 is substantially similar in construction to the article retention structures RT of the embodiment shown in FIGS. 4 and 8B and will not be described in further detail.

Each of the second article retention structures RT2 is substantially similar in construction and will be described in further detail with reference to the second article retention structure RT2 illustrated in FIGS. 7A and 9A albeit one of the minor cutaways N7, N8, N9 has been omitted and the circumferential location of the remaining cutaways has been modified. The second article retention structure RT2 of FIGS. 7B and 9B comprises an article receiving opening defined by a second aperture A2. The second article retention structure RT2 comprises a perimeter or engaging edge E2 defined by the second aperture A2. The second article retention structure RT2 comprises at least one cutaway C5, N5, N6 struck from the perimeter of the second aperture A2. However, the second article retention structure RT2 in FIG. 9B comprises first or major cutaway C5 and at least one second or minor cutaway N5, N6. The illustrated embodiment of FIG. 9B comprises two minor cutaways N5, N6. The first or major cutaway C5 is greater in angular dimension than the second or minor cutaways N5, N6. The first cutaway C5 comprises a first angular width or dimension. The second cutaways N5, N6 each comprises a second angular width or dimension. The first angular width or dimension is greater than the second angular width or dimension. The first angular width or dimension may be in the range 10° to 45° and may be about 31.25°. The second angular width or dimension may be less than 10°, may be in the range 5° to 30° and may be about 7.15°. The first angular width or dimension may be at least twice the magnitude of the second angular width or dimension and may be about three or four times greater in magnitude.

Referring to FIG. 9B, a first minor cutaway N5 is provided in an orthogonal relationship with respect to a second minor cutaway N6, that is to say the first and second minor cutaways N5, N6 are disposed about the perimeter of the second aperture A2 separated by an angle of 90°. A first notional line NL5 bisecting the major cutaway C5 and passing through the centre $C_e$ of the notional circle NC bisects a first load bearing edge or first arcuate segment S of the perimeter E2 of the second aperture A2 and also bisects the angle between the first and second minor cutaways N5, N6.

The first arcuate segment S is defined by circular cut lines each centred at a first centre $C_e$ and having a first radius of curvature $R_a$ defining a first circle NC. The first arcuate segment S is interrupted by the minor cutaways N5, N6 and divided into three portions.

The first notional line NL5 passing through the centre $C_e$ and through the centre or midpoint of the major cutaway C5 is perpendicular to a side edge "Se" of the main panel 812.

The second article retention structure RT2 of FIG. 9B comprises second and third arcuate segments S5, S6 arranged similarly to those of the embodiment of FIG. 9A.

The second article retention structure RT2 comprises four quadrants I, II, III, IV of the first circle NC. The quadrants are defined by the notional line passing through the centre $C_e$ and through the centre or midpoint of the major cutaway C5 that is perpendicular to a side edge "Se" of the main panel 812 and by a second notional line perpendicular to the first notional line and passing through the centre $C_e$ of the notional circle NC. First and second quadrants I, II are disposed in closest proximity to the side or longitudinal edge "Se" of the main panel 812. Third and fourth quadrants III, IV are disposed distally from the side or longitudinal edge "Se" of the main panel 812. The second centre $C_e$5 is disposed in the third quadrant III. The third centre $C_e$6 is disposed in the fourth quadrant IV.

FIG. 9B illustrates the position of an article B, in the illustrated embodiment a can, dashed line NC1 shows the position of the side wall of a main body portion of the article B and indicates the maximum diameter or width of the article B. The position of a rim or chime of the article B is indicated by dashed line NC2, the rim of the article B passes through the opening in the main panel 812 provided by the second article retention structure RT2. The rim may be provided by an end seam such as a canners end seam. The rim comprises a radius of curvature $R_b$. The rim radius $R_b$ is greater than the first radius of curvature $R_a$. The second aperture A2 and the major and minor cutaways C5, N5, N6 are arranged to be disposed within the footprint of the rim of the article B, in FIG. 9A the second aperture A2 and the major and minor cutaways C5, N5, N6 are arranged to be disposed substantially within the circle NC2.

The pair of minor cutaways N5, N6 may be considered to be generally disposed in opposition to the major cutaway C5.

In FIG. 9B, the first notional line NL5 defines an axis of symmetry about which the major and minor cutaways C5, N5, N6 are disposed symmetrically. In an alternative embodiment or optionally, the major and minor cutaways C5, N5, N6 may be asymmetrically arranged about the first notional line NL5.

The blanks 10; 110; 210; 310; 410; 510; 610; 710; 810 include at least a paperboard substrate. In an embodiment wherein each blank includes two or more substrates, the two or more substrates may optionally be laminated together before the carrier blank is die cut. The material of the paperboard substrate may be selected from any conventional paperboard, for example, ranging in weight upwardly from about 10 pt., preferably from about 16 pt. to about 28 pt. (0.028"/~0.7 mm). Examples of such a substrate are: 27-point (pt.) SBS board (solid bleached sulphate paperboard coated on one side, trade name PrintKote®) or CNK® board (Coated Natural Kraft®—an unbleached kraft paperboard having a clay coating on one side, trade name CarrierKote™); 21-point (pt.) SBS board or CNK® board; and E or F flute corrugated fibreboard, manufactured by WestRock® Company. The paperboard substrate may be a bleached or unbleached board. The board may be coated on at least one side, optionally the side opposite the lamination, with a conventional coating selected for compatibility with the printing method and board composition.

The blanks 10; 110; 210; 310; 410; 510; 610; 710; 810 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g., MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The present disclosure provides a carrier 190 of the top engaging type having article retention structures RT; RT1, RT2 for engaging articles B, and blank 10; 110; 210; 310; 410; 510; 610; 710; 810 for forming the same.

The carrier 190 comprises a main panel 12; 112; 212; 312; 412; 512; 612; 712; 812 having one or more article retention structures RT; RT1, RT2 for receiving a respective article B and suspending said article B therefrom.

The article retention structures RT; RT1, RT2 each comprise a perimeter or engaging edge E1, E2, the perimeter E1, E2 is interrupted by at least one major cutaway C1, C2, C3, C4, C5 in the form of a notch or recess and at least one minor cutaway N1, N2, N3, N4, N5, N6, N7, N8, N9 in the form of a notch or recess. The at least one major cutaway C1, C2, C3, C4, C5 comprises a first width and the at least one minor cutaway N1, N2, N3, N4, N5, N6, N7, N8, N9 comprises a second width. The first width is greater in magnitude than the second width. The at least one major cutaway C1, C2, C3, C4, C5 comprises or defines a first angular width and the at least one minor cutaway N1, N2, N3, N4, N5, N6, N7, N8, N9 comprises or defines a second width, the first angular width is greater in magnitude than the second angular width. The first angular width may be between three and six times greater in magnitude than the second angular width.

The at least one major cutaway C1, C2, C3, C4, C5 and the at least one minor cutaway N1, N2, N3, N4, N5, N6, N7, N8, N9 each comprise depth or radial dimension, the maximum radial dimension of the at least one major cutaway C1, C2, C3, C4, C5 and maximum radial dimension of the at least one minor cutaway N1, N2, N3, N4, N5, N6, N7, N8, N9 may be equal to each other.

The article retention structures RT; RT1, RT2 each comprise an engaging edge or perimeter E1, E2, the perimeter E1, E2 being defined by a first load bearing edge S having a first radius of curvature $R_a$ and a second load bearing edge S1, S2, S3, S5, S6 having a second radius of curvature $R_a1$, $R_a2$, $R_a3$, $R_a5$, $R_a6$, the second radius of curvature being larger than the first radius of curvature.

The perimeter E1, E2 may be defined by a first load bearing edge S having a first radius of curvature $R_a$ and at least one arcuate segment S1, S2, S3, S5, S6 having a second radius of curvature $R_a1$, $R_a2$, $R_a3$, $R_a5$, $R_a6$, the second radius of curvature being larger than the first radius of curvature.

The perimeter E1, E2 may be defined by a first load bearing edge S having a first radius of curvature $R_a$ and at least two arcuate segments S1, S2, S3, S5, S6 each having a second radius of curvature $R_a1$, $R_a2$, $R_a3$, $R_a5$, $R_a6$, the second radius of curvature being larger than the first radius of curvature.

The first load bearing edge S may be interrupted by, or comprise, at least one minor cutaway N1, N2, N3, N4, N5, N6, N7, N8, N9.

The second load bearing edge S1, S2, S3, S5, S6 may be interrupted by, or comprise, at least one major cutaway C1, C2, C3, C4, C5.

The at least one arcuate segment S1, S2, S3, S5, S6 may extend between a pair of major cutaways C1/C2, C3/C4.

The second load bearing edge S1, S2, S3, S5, S6 may be disposed in closer proximity to a side edge of the main panel 12; 112; 212; 312; 412; 512; 612; 712; 812 than the first load bearing edge S.

The second load bearing edge S1, S2, S3, S5, S6 may be disposed in closer proximity to an end edge of the main panel 12; 112; 212; 312; 412; 512; 612; 712; 812 than the first load bearing edge S.

The second load bearing edge S1, S2, S3, S5, S6 may be disposed in closer proximity to a corner of the main panel 12; 112; 212; 312; 412; 512; 612; 712; 812 than the first load bearing edge S.

The second load bearing edge S1, S2, S3, S5, S6 and the first load bearing edge S together define an aperture A1, A2 having a width or diameter smaller than the diameter or width of an upper rim of an article B to be received in the article retention structure RT; RT1, RT2.

The maximum radial dimension of the at least one major cutaway C1, C2, C3, C4, C5 and maximum radial dimension of the at least one minor cutaway N1, N2, N3, N4, N5, N6, N7, N8, N9 may be generally equal to the difference between the radius of curvature $R_b$ of a portion of an article B received in the article retention structures RT; RT1, RT2 and the first radius of curvature $R_a$.

The article retention structure RT; RT1, RT2 may comprise at least three cutaways C1, C2, C3, C4, C5, N1, N2, N3, N4, N5, N6, N7, N8, N9 including at least one major cutaway C1, C2, C3, C4, C5 and at least one minor cutaway N1, N2, N3, N4, N5, N6, N7, N8, N9.

The article retention structure RT; RT1, RT2 may comprise at least one major cutaway C1, C2, C3, C4, C5 disposed in opposition to at least one minor cutaway N1, N2, N3, N4, N5, N6, N7, N8, N9. In some such embodiments, the at least one major cutaway C1, C2, C3, C4, C5 and the at least one minor cutaway N1, N2, N3, N4, N5, N6, N7, N8, N9 may define an opening having a width or diameter substantially equal to the diameter or width of an upper rim of an article B to be received in the article retention structure RT; RT1, RT2.

The article retention structure RT; RT1, RT2 may comprise at least two major cutaways C1, C2, C3, C4, C5 disposed orthogonally to each other.

The article retention structure RT; RT1, RT2 may comprise at least two minor cutaways N1, N2, N3, N4, N5, N6, N7, N8, N9 disposed orthogonally to each other.

The present disclosure also provides a carrier 190 comprising a main panel 12; 112; 212; 312; 412; 512; 612; 712; 812 having one or more article retention structures RT; RT1 for receiving and securing a respective article B.

The article retention structures RT; RT1 each comprise an engaging edge or perimeter E1, the perimeter E1 may optionally be interrupted by at least two cutaways C1, C2 in the form of a notch or recess. A first cutaway C1 is disposed orthogonally to a second cutaway C2. The first cutaway C1 interrupts a portion of the perimeter E1 disposed in closest proximity to a side edge of the main panel 12; 112; 212; 312; 412; 512; 612; 712; 812. The second cutaway C2 interrupts a portion of the perimeter E1 disposed in closest proximity to an end edge of the main panel 12; 112; 212; 312; 412; 512; 612; 712; 812, said end edge is disposed adjacent to the side edge.

The perimeter E1 may be defined by a first load bearing edge S having a first radius of curvature $R_a$ and at least one arcuate segment S1, S2, S3, S5, S6 having a second radius of curvature $R_a$1, $R_a$2, $R_a$3, $R_a$5, $R_a$6, the second radius of curvature being larger than the first radius of curvature.

The perimeter E1 may comprise arcuate segments S1, S2, S3, S5, S6 each having a second radius of curvature $R_a$1, $R_a$2, $R_a$3, $R_a$5, $R_a$6 and disposed on opposing sides of a cutaway C1, C2, C5.

The perimeter E1 may comprise an arcuate segment S1, S2, S3, S5, S6 having a second radius of curvature $R_a$1, $R_a$2, $R_a$3, $R_a$5, $R_a$6 and a first centre $C_e$1, $C_e$2, $C_e$3, $C_e$5, $C_e$6 of radius of curvature on a first side of a cutaway C1, C2, C5 and another arcuate segment S1, S2, S3, S5, S6 having a second radius of curvature $R_a$1, $R_a$2, $R_a$3, $R_a$5, $R_a$6 and a second centre $C_e$1, $C_e$2, $C_e$3, $C_e$5, $C_e$6 of radius of curvature on a second side of a cutaway C1, C2, C5, wherein the two arcuate segments S1, S2, S3, S5, S6 adjoin or sandwich the cutaway C1, C2, C5.

The second load bearing edge S1, S2, S3, S5, S6 may be interrupted by, or comprise, the at least two cutaways C1, C2.

Embodiments of the disclosure provide an article retention structures RT; RT1, RT2 for receiving an article B having an engagement feature such as but not limited to, a flange, rim, undercut, ridge or protrusion, the engagement feature having a circular cross-section.

It can be appreciated that various changes may be made within the scope of the present disclosure. For example, the size and shape of the panels and apertures may be adjusted to accommodate articles of differing size or shape. The shoulder panels may be omitted. The present disclosure is not limited to cartons of the top-engaging type, the disclosure may be employed with other carton styles such as, but not limited to, open top crates, lidded or closed top crates.

It will be recognised that as used herein, directional references such as "top", "bottom", "base", "front", "back", "end", "side", "inner", "outer", "upper" and "lower" do not necessarily limit the respective panels to such orientation but may merely serve to distinguish these panels from one another.

The invention claimed is:

1. An article carrier for packaging at least one article, the carrier comprising a main panel having at least one article retention structure for engaging an article, the at least one article retention structure comprising an aperture having a perimeter, wherein the perimeter includes a first load bearing edge having a first radius of curvature and a second load bearing edge having a second radius of curvature, the second radius of curvature being greater than the first radius of curvature, wherein the second load bearing edge is disposed in closer proximity to a side edge of the main panel than the first load bearing edge and wherein the second load bearing edge is disposed in closer proximity to an end edge of the main panel than the first load bearing edge, the second load bearing edge is interrupted by at least one cutaway such that the second load bearing edge is divided by the at least one cutaway into two or more arcuate segments each having the second radius of curvature.

2. An article carrier according to claim 1, wherein the two or more arcuate segments have different centers of curvature spaced apart from each other.

3. An article carrier according to claim 1, wherein the at least one cut away comprises at least two cutaways.

4. An article carrier according to claim 3, wherein each of the at least two cutaways is disposed between the two or more arcuate segments.

5. An article carrier according to claim 1, wherein the second load bearing edge is disposed in closer proximity to a corner of the main panel than the first load bearing edge.

6. A carrier according to claim 1, wherein the at least one cutaway is disposed symmetrically about an axis of symmetry.

7. A carrier according to claim 1, wherein the at least one cutaway is disposed asymmetrically about a notional line.

8. A blank for forming an article carrier for packaging at least one article, the blank comprising a main panel having at least one article retention structure for engaging an article, the at least one article retention structure comprising an aperture having a perimeter, wherein the perimeter includes a first load bearing edge having a first radius of curvature and a second load bearing edge having a second radius of curvature, the second radius of curvature being greater than the first radius of curvature, wherein the second load bearing edge is disposed in closer proximity to a side edge of the main panel than the first load bearing edge and wherein the second load bearing edge is disposed in closer proximity to an end edge of the main panel than the first load bearing edge, the second load bearing edge is interrupted by at least one cutaway such that the second load bearing edge is divided by the at least one cutaway into two or more arcuate segments each having the second radius of curvature.

9. A blank according to claim 8, wherein the two or more arcuate segments have different centers of curvature spaced apart from each other.

10. A blank according to claim 8, wherein the at least one cut away comprises at least two cutaways.

11. A blank according to claim 10, wherein each of the at least two cutaways is disposed between the two or more second load bearing edges.

12. A blank according to claim 8, wherein the at least one cutaway is disposed symmetrically or asymmetrically about a notional line.

13. A blank for forming an article carrier, the blank comprising a main panel having at least one article retention structure for engaging an article, the at least one article retention structure comprising an aperture having a perimeter, wherein the perimeter is interrupted by at least one major cutaway and at least one minor cutaway, wherein the at least one major cutaway comprises a first angular dimension and the at least one minor cutaway comprises a second angular dimension, the first angular dimension being greater in magnitude than the second angular dimension, wherein a radially outermost ends of the at least one of the major cutaway and the minor cutaway is disposed generally at an outer perimeter of an upper rim of an article to be received in the at least one article retention structure.

14. A bank, according to claim 13, wherein the perimeter of the aperture includes a load bearing edge for engaging an upper rim of an article to be received in the at least one article retention structure, the load bearing edge extending between the at least one major cutaway and the at least one minor cutaway.

15. A blank, according to claim 13, wherein the at least one major cutaway and the at least one minor cutaway are disposed symmetrically or asymmetrically about a notional line.

* * * * *